US007600978B2

(12) United States Patent
Vance et al.

(10) Patent No.: US 7,600,978 B2
(45) Date of Patent: Oct. 13, 2009

(54) HOLLOW CMC AIRFOIL WITH INTERNAL STITCH

(75) Inventors: Steven J. Vance, Oviedo, FL (US); Jay A. Morrison, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 476 days.

(21) Appl. No.: 11/494,176

(22) Filed: Jul. 27, 2006

(65) Prior Publication Data

US 2008/0025846 A1 Jan. 31, 2008

(51) Int. Cl.
*F01D 5/18* (2006.01)

(52) U.S. Cl. ..... 416/230; 416/233; 416/241 B

(58) Field of Classification Search ..... 416/233, 416/241 B, 230
See application file for complete search history.

(56) References Cited

U.S. PATENT DOCUMENTS 5,306,554 A 4/1994 Harrison et al.
5,308,228 A * 5/1994 Benoit et al. ..... 416/230
5,382,453 A 1/1995 Mason
5,630,700 A 5/1997 Olsen et al.
6,325,593 B1 12/2001 Darkins, Jr. et al.
6,398,501 B1 6/2002 Darkins, Jr. et al.
6,431,837 B1 * 8/2002 Velicki ..... 416/230
6,451,416 B1 9/2002 Holowczak et al.
6,514,046 B1 2/2003 Morrison et al.
6,709,230 B2 * 3/2004 Morrison et al. ..... 416/241 B
2005/0076504 A1 * 4/2005 Morrison et al. ..... 29/889.72

* cited by examiner

*Primary Examiner*—Richard Edgar

(57) ABSTRACT

A CMC airfoil (20) formed with CMC stitches (37) interconnected between opposed walls (26, 28) of the airfoil to restrain outward flexing of the walls resulting from pressurized cooling air within the airfoil. The airfoil may be formed of a ceramic fabric infused with a ceramic matrix and dried, and may be partially to fully cured. Then holes (32, 34) are formed in the opposed walls of the airfoil, and a ceramic stitching element such as ceramic fibers (36) or a ceramic tube (44) is threaded through the holes. The stitching element is infused with a wet ceramic matrix before or after threading, and is flared (38) or otherwise anchored to the walls (26, 28) to form a stitch (37) there between. The airfoil and stitch are then cured. If the airfoil is cured before stitching, a pretension is formed in the stitch due to relative curing shrinkage.

22 Claims, 3 Drawing Sheets

HOLLOW CMC AIRFOIL WITH INTERNAL STITCH

FIELD OF THE INVENTION

The invention relates to ceramic matrix composite (CMC) fabrication technology for airfoils that are internally cooled with compressed air, such as turbine blades and vanes in gas turbine engines.

BACKGROUND OF THE INVENTION

Design requirements for internally cooled airfoils necessitate a positive pressure differential between the internal cooling air and the external hot gas environment to prevent hot gas intrusion into the airfoil in the event of an airfoil wall breach. CMC airfoils with hollow cores in gas turbines are particularly susceptible to wall bending loads associated with such pressure differentials due to the anisotropic strength behavior of CMC material. For laminate CMC constructions, the through-thickness direction has about 5% of the strength of the in-plane or fiber-direction strengths. Internal cooling air pressure causes high interlaminar tensile stresses in a hollow CMC airfoil, with maximum stress concentrations typically occurring at the inner radius of the trailing edge region. The inner radius of the leading edge region is also subject to stress concentrations.

This problem is accentuated in large airfoils with long chord length, such as those used in large land-based gas turbines. A longer internal chamber size results in increased bending moments on the walls of the airfoil, resulting in higher stresses for a given inner/outer pressure differential.

The most common method of reducing these stresses in metal turbine vanes is to provide internal metal spars that run the full or partial radial length of the airfoil. However this is not fully satisfactory for CMC airfoils, due to manufacturing constraints and also due to thermal radial expansion stress that builds between the hot airfoil skin and the cooler spars. Therefore, the present inventors have recognized that better methods are needed for reducing bending stresses in hot CMC airfoil walls resulting from internal cooling pressurization.

BRIEF DESCRIPTION OF THE DRAWINGS

The invention is explained in following description in view of the drawings that show.

DETAILED DESCRIPTION OF THE INVENTION

Figure 1:
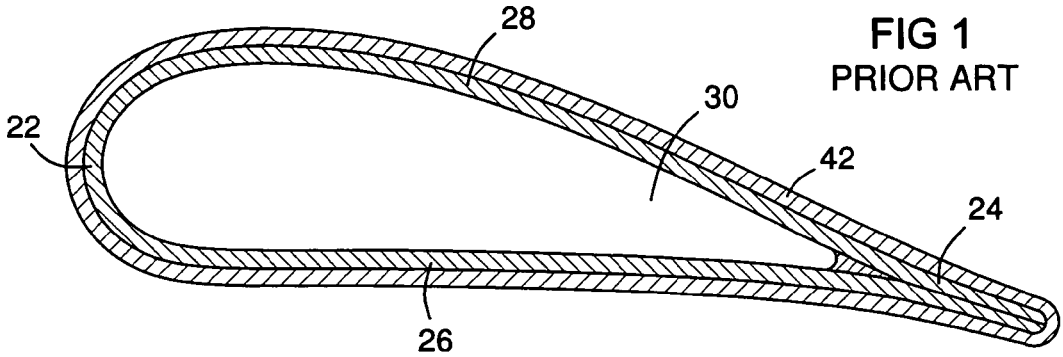
FIG 1 PRIOR ART
FIG. 1 is a sectional view of a prior art CMC airfoil with a hollow interior and an insulating outer layer.

FIG. 1 shows a sectional view of a prior art hollow CMC airfoil formed with walls made of a ceramic fabric infused with a ceramic matrix. The airfoil has a leading edge 22, a trailing edge 24, a pressure wall 26, a suction wall 28, and an interior space 30. It may also have an insulative outer layer 42. High-temperature insulation for ceramic matrix composites has been described in U.S. Pat. No. 6,197,424, incorporated by reference herein, which issued on Mar. 6, 2001, and is commonly assigned with the present invention.

Figure 2:
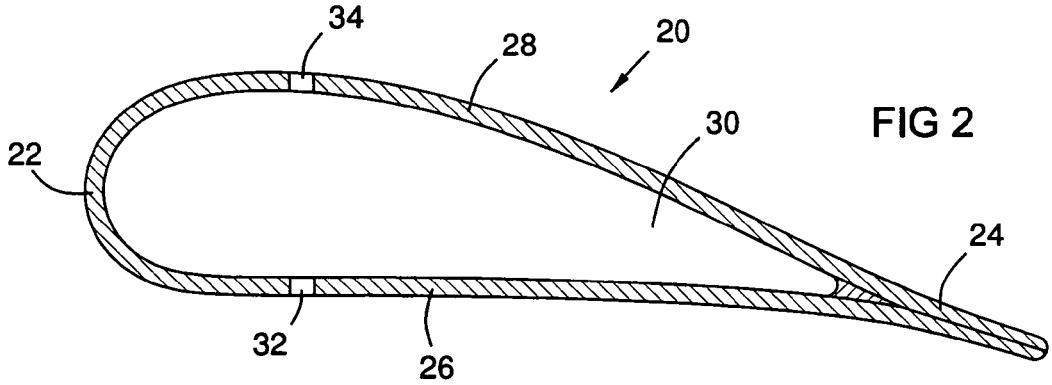
FIG. 2 is a sectional view of a CMC airfoil according to one embodiment of the invention after forming walls and drilling holes to receive a CMC stitch.
Figure 3:
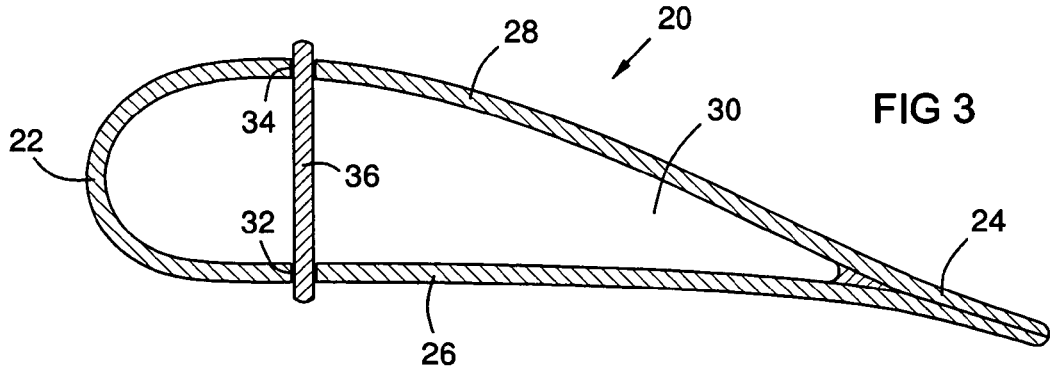
FIG. 3 is a view as in FIG. 2 after passing a bundle of ceramic fibers through holes in opposed walls of the airfoil.
Figure 4:
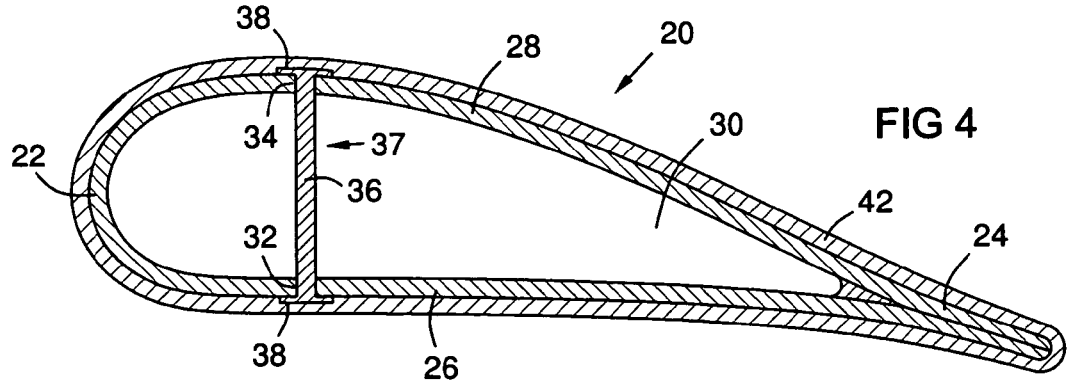
FIG. 4 is a view as in FIG. 3 after flaring the bundle of ceramic fibers at both ends for anchoring, and then adding an insulating outer layer on the airfoil walls, thus forming a hidden stitch.

FIG. 2 shows a CMC airfoil 20 with holes 32 and 34 formed in the pressure and suction walls 26, 28. The holes 32, 34 may be formed by any known technique, for example laser drilling, after drying or partially to fully curing the CMC walls 26, 28. FIG. 3 shows a bundle of ceramic fibers 36 passing through the holes 32 and 34. FIG. 4 shows the bundle of ceramic fibers 36 flared 38 at both ends against outer surfaces of the walls 26, 28. The bundle of ceramic fibers 36 is now interconnected between the opposed walls 26 and 28 forming a stitch 37 that resists the walls 26, 28 from being flexed outward under pressure from cooling air in the interior space 30. The bundle of ceramic fibers may have a cross section with an aspect ratio of less than 6:1, or less than 4:1, or less than 2:1, such as a generally circular cross section, in order to provide sufficient strength to avoid structural failure while still avoiding excessive thermal expansion stress as may be experienced with prior art spars. The bundle of fibers may include ceramic fibers that are oriented generally along a longitudinal axis of the bundle (i.e. along an axis between the opposed walls), and/or the fibers may be woven in any desired pattern. An insulating outer layer 42 may be applied on the airfoil 20 after stitching.

Figure 5:
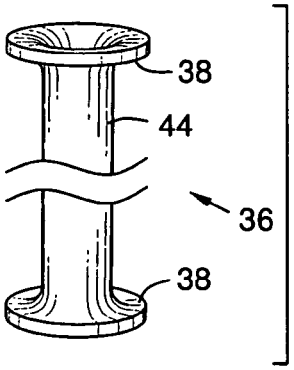
FIG. 5 is an enlarged perspective view of a CMC tube with flared ends.

FIG. 5 shows an enlarged view of a bundle of ceramic fibers 36 in the form of a tube 44 with flairs 38. Commercially available braided tubes of ceramic fiber may be cut to length, infused with a fluid ceramic matrix, inserted through holes 32, 34 formed in the airfoil walls 26, 28, flared 38 on each end, dried, and fired.

Figure 6:
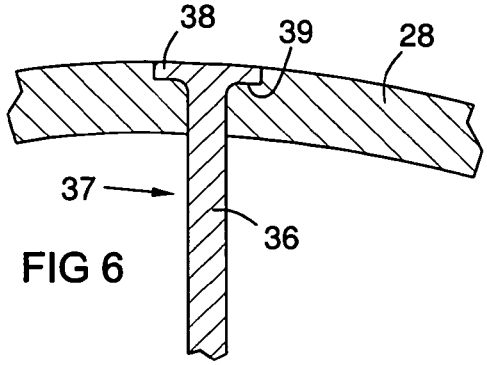
FIG. 6 is an enlarged partial sectional view of an end of a bundle of ceramic fibers flared within a countersunk area in an outer surface of an airfoil wall for flush anchoring of the stitch.

FIG. 6 shows an enlarged partial section of a suction wall 28 with a bundle of ceramic fibers 36 flared 38 in a countersunk area 39 in the outer surface of the suction wall 28. The flare 38 may be smoothed flush with the outer surface of the suction wall 28. A corresponding countersink may be provided in the pressure wall 26 at the other end of the bundle of ceramic fibers 36.

Figure 7:
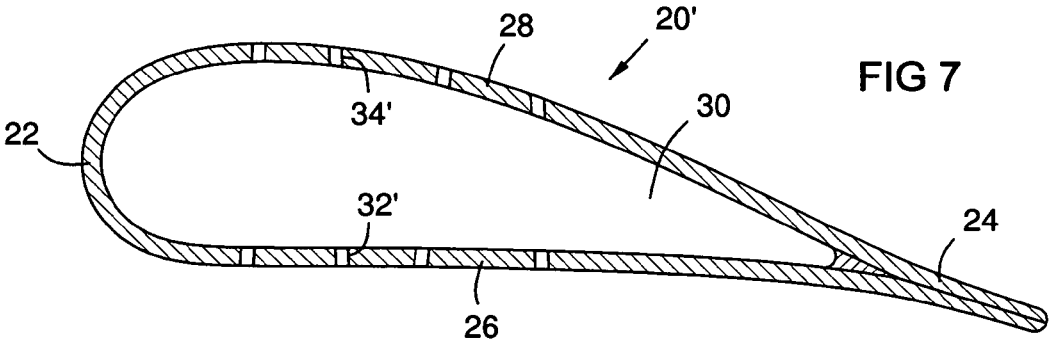
FIG. 7 illustrates a preparation step as in FIG. 2 in an embodiment with a plurality of holes in the walls for multiple stitches with a continuous bundle of ceramic fibers.
Figure 8:
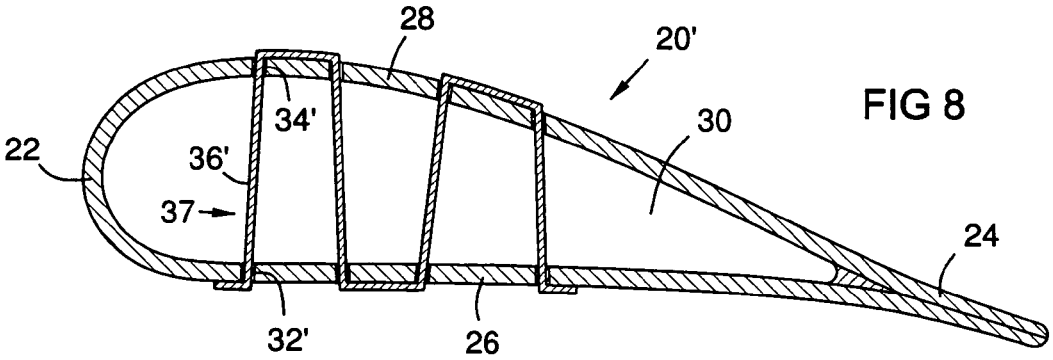
FIG. 8 is a view as in FIG. 7 after stitching.

FIG. 7 shows an embodiment of an airfoil 20' according to the invention with a plurality of holes 32', 34' formed in opposed walls 26, 28. FIG. 8 shows a bundle of ceramic fibers 36' continuously threaded through the holes 32', 34' to form a plurality of stitches 37.

Figure 9:
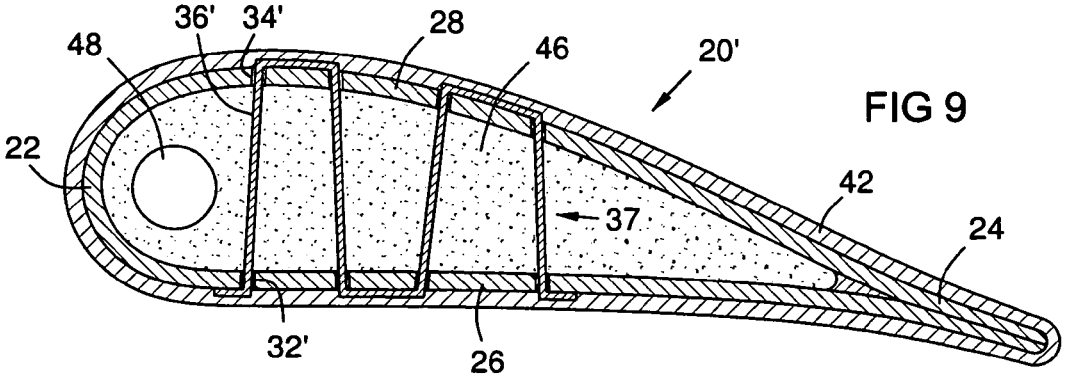
FIG. 9 is a view as in FIG. 8 after adding an internal core material and an insulating outer layer on the airfoil walls, covering the stitches.

FIG. 9 shows a ceramic core 46 that may be poured or injected into the interior space 30, either before or after stitching. If the core 46 is applied after stitching, it flows around and encases the stitches 37 as shown. If the core 46 is applied before stitching, it is dried, and may be partially to fully cured. Then it may be laser drilled along with each pair of holes 32', 34' creating tunnels (not shown) through the core 46 for the stitches 37. A fugitive material (not shown) may be applied in a pattern in the interior space 30 before pouring or injecting the core 46 to create cooling air channels 48 in the core. Examples of this type of core are shown in U.S. Pat. No. 6,709,230, incorporated by reference herein, which issued on Mar. 23, 2004, and is commonly assigned with the present invention. Only a main cooling channel 48 is shown here. Tributary channels (not shown) may branch from the main channel 48, pass along the inside surface of the walls 22-28 between the stitches 37, and have exit holes on at least one of the walls 22, 26, 28. A fugitive material may be used to create channels through the core 46 for subsequently receiving a stitching element 37. An insulating outer layer 42 may be applied on the airfoil 20' after stitching.

Figure 10:
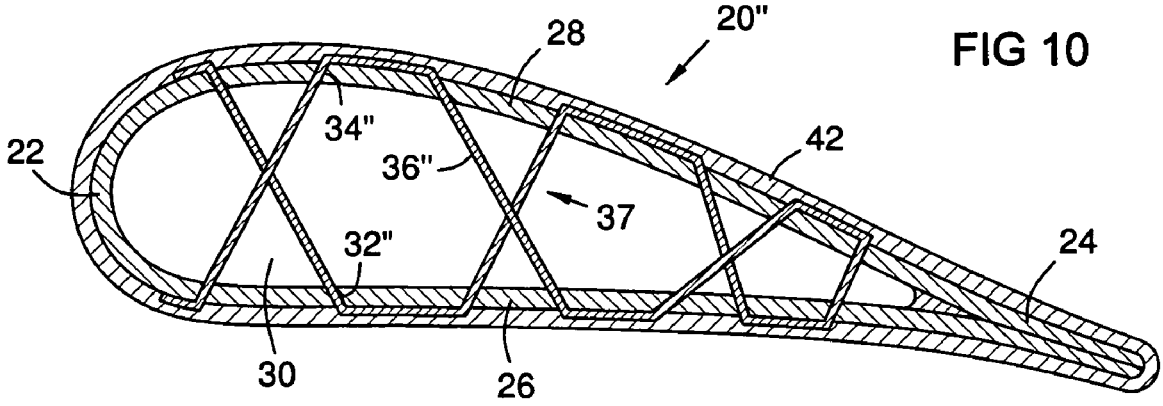
FIG. 10 illustrates an embodiment with bidirectional stitching.

FIG. 10 shows an embodiment of an airfoil 20" with bidirectional stitching with a bundle of ceramic fibers 36" to provide a plurality of crossing stitches 37. The stitch holes 32", 34" may be offset along the length dimension of the airfoil (not shown), so that the stitches 37 do not touch each other.

Variations on the processing steps are possible. For example, the airfoil may be formed and only dried, or it may be partially or fully cured prior to inserting the stitching element(s). Then ceramic fiber bundles 36 or tubes 44 may be stitched into the airfoil 20 prior to or after ceramic matrix infusion. The ceramic matrix bundles 36 or tubes 44 may be infused and/or cured along with the airfoil or they may be processed separately or only partially together. Possible firing sequences may include firing the CMC airfoil 20 prior to stitching to preshrink the walls 22-28. Then the stitching 37 may be applied and fired. This results in a pre-tensioning of the cured stitching 37 that preloads the walls 22-28 in compression, further increasing its resistance to internal pressure. Similarly, drying and firing sequences for the airfoil walls 22, 26, 28, the stitches 37 and the internal core 46 may be selected to facilitate manufacturing and/or to control relative shrinkage and pre-loading among these elements.

While various embodiments of the present invention have been shown and described herein, it will be obvious that such embodiments are provided by way of example only. Numerous variations, changes and substitutions may be made without departing from the invention herein. For example, the invention may be applied to both oxide and non-oxide materials, and the material used to form the stitch may be the same as or different than the material used to form the airfoil walls. The stitch material may be selected considering its coefficient of thermal expansion, among other properties, in order to affect the relative amount of thermal expansion between the stitch and the airfoil walls during various phases of operation of the article. The stitch may be formed of a CMC material or a metallic material, such as tungsten or other refractory metal or a superalloy material including oxide dispersion strengthened alloys, in various embodiments. This invention may be applied to hollow articles other than airfoils where resistance to a ballooning force and additional stiffness are desired. The stitches may be distributed evenly across an airfoil chord, or they may be placed strategically in locations that provide the most advantageous reduction in critical stresses or that reduce or eliminate mechanical interference for other internal structures. In one embodiment a stitch is located just forward of a critically stressed trailing edge of an airfoil, or proximate an unbonded region between an airfoil wall 26, 28 and an internal core 46 in order to reinforce an edge of a bonded region. Accordingly, it is intended that the invention be limited only by the appended claims.

The invention claimed is:

1. A method of forming a CMC airfoil, comprising:

forming with a CMC material a leading edge, a trailing edge, a pressure wall between the leading and trailing edges, and a suction wall between the leading and trailing edges;

forming a hole in the pressure wall and forming a generally opposed hole in the suction wall; and passing a bundle of ceramic fibers through the holes to form a stitch of ceramic fibers between the pressure and suction walls;

wherein the forming step comprises impregnating CMC fabric with a first ceramic matrix, shaping the impregnated fabric to form the leading and trailing edges and the pressure and suction walls, and drying the impregnated fabric prior to the hole forming step; wherein the passing step further comprises infusing the ceramic fibers with a second ceramic matrix; and further comprising curing the stitched walls and the stitch together after the passing step; and at least partially curing the impregnated fabric prior to curing the stitched walls and the stitch together in order to generate a preload in the stitch due to differential curing shrinkage.

2. A method as in claim 1, further comprising forming the CMC stitch with a material different than the CMC material used to form the leading and trailing edges and the pressure and suction walls.

3. A method as in claim 1, wherein a plurality of holes are formed in the pressure and suction walls, and the bundle of ceramic fibers is continuously woven through the plurality of holes to form a plurality of stitches of ceramic fibers between the pressure and suction walls.

4. A method as in claim 1, further comprising after the passing step:

filling an interior space between the pressure and suction walls with a flowable ceramic core material; and curing the airfoil, the stitch, and the core material together.

5. A method as in claim 1, further comprising;

impregnating the bundle of ceramic fibers with a ceramic matrix;

anchoring the stitch of ceramic fibers to the pressure and suction walls at each of the holes; and curing the stitch of impregnated ceramic fibers to form a reinforcement between the pressure and suction walls to restrain outward flexing of the pressure and suction walls.

6. A method as in claim 5, wherein the bundle of ceramic fibers comprises ceramic fibers oriented generally along a longitudinal axis of the bundle of ceramic fibers.

7. A method as in claim 5, wherein the bundle of ceramic fibers comprises a tube of ceramic fibers comprising first and second ends, and wherein the anchoring step comprises flaring each respective end of the tube of ceramic fibers against a respective outer surface of the pressure and suction walls proximate each of the respective holes.

8. A method as in claim 5, further comprising forming a countersunk area around each of the holes on an outer surface of the pressure and suction walls prior to the passing step, and wherein the anchoring step comprises flaring each respective end of the bundle of ceramic fibers against the respective countersunk areas.

9. A method as in claim 5, wherein the cured stitch of ceramic fibers has a cross sectional aspect ratio of less than 2:1.

10. A method as in claim 5, wherein the cured stitch has a generally circular cross sectional shape.

11. A CMC airfoil with an internal stitch formed by the method of claim 1.

12. A method of forming a CMC airfoil, comprising:

forming with a CMC material a leading edge, a trailing edge, a pressure wall between the leading and trailing edges, and a suction wail between the leading and trailing edges;

forming a hole in the pressure wall and forming a generally opposed hole in the suction wall; and passing a bundle of ceramic fibers through the holes to form a stitch of ceramic fibers between the pressure and suction walls;

impregnating the bundle of ceramic fibers with a ceramic matrix;

anchoring the stitch of ceramic fibers to the pressure and suction walls at each of the holes; and curing the stitch of impregnated ceramic fibers to form a reinforcement between the pressure and suction walls to restrain outward flexing of the pressure and suction walls;

wherein the CMC airfoil is at least partly cured before the anchoring step, and the stitch of impregnated ceramic fibers is cured after the anchoring step, such that a curing shrinkage of the CMC stitch results in a pre-tensioning of the CMC stitch between the pressure and suction walls of the airfoil.

13. A method of forming a CMC airfoil, comprising:

forming with a CMC material a leading edge, a trailing edge, a pressure wall between the leading and trailing edges, and a suction wall between the leading and trailing edges;

forming a hole in the pressure wall and forming a generally opposed hole in the suction wall; and passing a bundle of ceramic fibers through the holes to form a stitch of ceramic fibers between the pressure and suction walls;

impregnating the bundle of ceramic fibers with a ceramic matrix;

anchoring the stitch of ceramic fibers to the pressure and suction walls at each of the holes; and curing the stitch of impregnated ceramic fibers to form a reinforcement between the pressure and suction walls to restrain outward flexing of the pressure and suction walls;

wherein the bundle of ceramic fibers comprises a tube of ceramic fibers comprising first and second ends, and wherein the anchoring step comprises flaring each respective end of the tube of ceramic fibers against a respective outer surface of the pressure and suction walls proximate each of the respective holes.

14. A method of forming a CMC airfoil, comprising:

forming with a CMC material a leading edge, a trailing edge, a pressure wall between the leading and trailing edges, and a suction wall between the leading and trailing edges;

forming a hole in the pressure wall and forming a generally opposed hole in the suction wall; and passing a bundle of ceramic fibers through the holes to form a stitch of ceramic fibers between the pressure and suction walls;

impregnating the bundle of ceramic fibers with a ceramic matrix;

anchoring the stitch of ceramic fibers to the pressure and suction walls at each of the holes;

curing the stitch of impregnated ceramic fibers to form a reinforcement between the pressure and suction walls to restrain outward flexing of the pressure and suction walls; and forming a countersunk area around each of the holes on an outer surface of the pressure and suction walls prior to the passing step, and wherein the anchoring step comprises flaring each respective end of the bundle of ceramic fibers against the respective countersunk areas.

15. A CMC airfoil comprising:

a first CMC wall and a second CMC wall spaced apart from each other to define an interior space; and a stitch interconnected between the first CMC wall and the second CMC wall;

a flare at each opposed end of the stitch disposed against a respective surface of the respective wall; and a layer of ceramic insulating material disposed over each respective wall and its respective flare.

16. A CMC airfoil as in claim 15, wherein the stitch comprises a bundle of ceramic fibers oriented generally along a longitudinal axis of the stitch, wherein the bundle of ceramic fibers is impregnated with a ceramic matrix and has a cross sectional aspect ratio of less than 2:1.

17. A CMC airfoil comprising:

a first CMC wall and a second CMC wall spaced apart from each other to define an interior space; and a stitch interconnected between the first CMC wall and the second CMC wall;

wherein the stitch comprises a braided tube of ceramic fibers impregnated with a ceramic matrix, and wherein the braided tube is flared at each end against a surface of the respective wall.

18. A CMC airfoil as in claim 17, further comprising a countersunk area formed in each respective wall, and the braided tube being flared at each respective end against the respective countersunk area.

19. A CMC airfoil as in claim 17, wherein the stitch is pre-stressed in tension between the walls.

20. A CMC airfoil as in claim 17, wherein the stitch is passed through a first hole in the first wall and a second hole in the second wall.

21. A CMC airfoil as in claim 17, further comprising a ceramic core disposed in the interior space and encasing the stitch.

22. A CMC airfoil as in claim 17, further comprising a layer of ceramic insulating material disposed over each respective wall and its respective flare.

* * * * *